US006242678B1

(12) United States Patent
Williams

(10) Patent No.: US 6,242,678 B1
(45) Date of Patent: Jun. 5, 2001

(54) MUSICAL INSTRUMENT OPEN HOLE CUP PLUG, PLUG REMOVAL/STORAGE TOOL, AND KIT

(75) Inventor: Robert Williams, Wakefield, MA (US)

(73) Assignee: Verne Q. Powell Flutes, Inc., Maynard, MA (US)

( * ) Notice: Subject to any disclaimer, the term of this patent is extended or adjusted under 35 U.S.C. 154(b) by 0 days.

(21) Appl. No.: 09/521,905

(22) Filed: Mar. 9, 2000

(51) Int. Cl.[7] ..... G10D 7/08

(52) U.S. Cl. ..... 84/385 P; 84/384; 84/453; 84/458

(58) Field of Search ..... 84/385 P, 384, 84/453, 458, 460; 81/176.1, 176.15

(56) References Cited

U.S. PATENT DOCUMENTS

| | | | | |
|---|---|---|---|---|
| 4,315,339 | * | 2/1982 | Lightner | 7/138 |
| 5,183,954 | | 2/1993 | Wasser | 84/385 P |
| 5,297,466 | | 3/1994 | Wasser | 84/385 P |
| 5,320,460 | * | 6/1994 | Murakami et al. | 411/55 |
| 5,339,719 | | 8/1994 | Wasser | 84/385 P |
| 5,381,718 | | 1/1995 | Wasser | 84/385 P |
| 5,469,771 | | 11/1995 | Wasser | 84/385 P |
| 6,034,312 | * | 3/2000 | Lubell et al. | 84/384 |

* cited by examiner

*Primary Examiner*—Shih-Yung Hsieh
(74) *Attorney, Agent, or Firm*—Iandiorio & Teska

(57) ABSTRACT

A musical instrument open hole cup plug, a plug removal/storage tool, and a kit which includes the tool and a number of the open hole cup plugs. Each plug includes spaced upper and lower circular plates and the upper plate has a lower seating surface for aesthetically positioning the upper plate over the open hole in the cup. An elastomeric member is disposed between the upper and lower plates for sealing the open hole. The plug removal/storage tool has a body including on a distal end thereof a protrusion, and a plurality of orifices in the body along the length thereof for storing the open hole cup plugs therein.

33 Claims, 3 Drawing Sheets

MUSICAL INSTRUMENT OPEN HOLE CUP PLUG, PLUG REMOVAL/STORAGE TOOL, AND KIT

FIELD OF THE INVENTION

This invention relates to a musical instrument open hole tone hole cup plug, plug removal/storage tool, and a kit including a set of plugs and the removal/storage device.

BACKGROUND OF THE INVENTION

Tone hole cups are that part of a wind instrument which cover the tone holes. Musical instruments such as flutes are available in two varieties, closed hole (also called the "American" style) and open hole or "French" cup style. The French or open hole style (i.e., cups with holes in them) are often preferred by more advanced musicians who perform "half holing", an advanced playing technique. Musicians who are beginning to learn this advanced technique often use removable open hole cup plugs which fit in the open hole cups and seal the open hole. When the musician wishes to practice more advanced techniques, he or she removes the plugs.

The use of removable open hole cup plugs is also advantageous from an inventory and cost standpoint, since a flute manufacturer can sell open hole cup flutes in combination with a set of plugs, and then the consumer can use the flute either as a closed hole cup style flute or as a French, open hole cup style flute.

In the prior art, the open hole cup plugs were typically made of either cork or silicone. There are several disadvantages associated with these types of plugs.

First, they are not very aesthetically pleasing. A high quality flute can be quite expensive and a silicone or cork open hole cup plug can seriously detract from the overall high quality appearance of the flute.

Second, in high quality flutes and other wind instruments, the goal is to achieve a certain resonance and pitch of each tone hole via quality cup pad materials precisely oriented in the cups. See U.S. Pat. Nos. 5,183,954 and 5,339,719 incorporated herein by this reference. But, cork and silicone open cup hole plugs have been found to adversely affect the resonance qualities of the musical instrument.

Third, in the prior art, there are no convenient means for storing the plugs and thus they were often lost or misplaced. Contributing to this fact is that in order to remove a cork or silicone plug, the musician is required to push the plug down through the tone hole and then shake the plug out of the end of the musical instrument.

BRIEF SUMMARY OF THE INVENTION

It is therefore an object of this invention to provide an aesthetically pleasing, high quality open hole cup plug.

It is a further object of this invention to provide such an open hole cup plug which does not adversely affect the resonance and pitch of the musical instrument.

It is a further object of this invention to provide such a combined plug removal and plug storage tool.

It is a further object of this invention to provide a musical instrument open hole cup kit which includes a combined plug remover and plug storage tool incorporating therewith a number of high quality, aesthetically pleasing open hole cup plugs.

It is a further object of this invention to provide such a kit which prevents the loss or misplacement of open hole cup plugs of any configuration.

This invention results from the realization that a more aesthetically pleasing and robust musical instrument open hole cup plug which does not adversely affect the resonance of the cup and which effectively seals the open hole in the cup is achieved by spaced upper and lower circular metal plates, an elastomeric member between the plates for sealing the open hole in the cup, and a sealing surface on the upper plate configured to seat the upper plate flush with the cup. Such a well seated plug must be carefully removed from the cup and thus the invention further features a plug removal tool with orifices therein which function to conveniently store the plugs once they are removed from the musical instrument. In the preferred embodiment, the musician is provided with a kit which includes the plug removal tool and a number of plugs storable thereon.

This invention features a musical instrument open hole cup plug kit including a plurality of open hole cup plugs and a plug removal/storage tool. In the preferred embodiment, each plug includes spaced upper and lower circular plates wherein the upper plate includes a lower seating surface for aesthetically positioning the upper plate over the open hole. An elastomeric member is disposed between the upper and lower plates for sealing the open hole. The plug removal/storage tool includes a body including on a distal end thereof a protrusion, and a plurality of orifices in the body along the length thereof for storing the open hole cup plugs therein.

In the preferred embodiment, each plug further includes a stem connected on one end to the upper plate and connected on the other end to the lower plate and an O-ring disposed about the stem. A depression is preferably formed in an upper surface of the upper plate. The upper plate of the plug typically has a diameter greater than the diameter of the elastomeric member and the elastomeric member has a diameter greater than the diameter of the lower plate of the plug. The lower seating surface of the upper plate of the plug has a radius configured to position the upper plate flush within a cup.

The distal end of the body of the tool is typically enlarged to span a tone hole rim and the body of the tool has a length greatly exceeding its thickness. Usually, the orifices in the tool extend completely through the thickness of the body and typically there are five such orifices.

This invention also features a novel musical instrument open hole cup plug with spaced upper and lower circular plates, the upper plate including a lower seating surface for aesthetically positioning the upper plate over the open hole; and an elastomeric member disposed between the upper and lower plates for sealing the open hole. This plug configuration is useful both as a component of the kit discussed above and also separate and apart from the tool and the kit.

This invention also features a musical instrument open hole cup plug removal and storage tool which preferably is used in connection with the plug described above but which also can be used in connection with prior art cork and silicone plugs. The tool has a body including on a distal end thereof a protrusion; and a plurality of orifices in the body along the length thereof for receiving and orderly retaining open hole plugs therein removed from the open hole cups when the distal end of the body is placed between a tone hole rim and an open hole cup and the protrusion is used to dislodge the plug from the cup.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
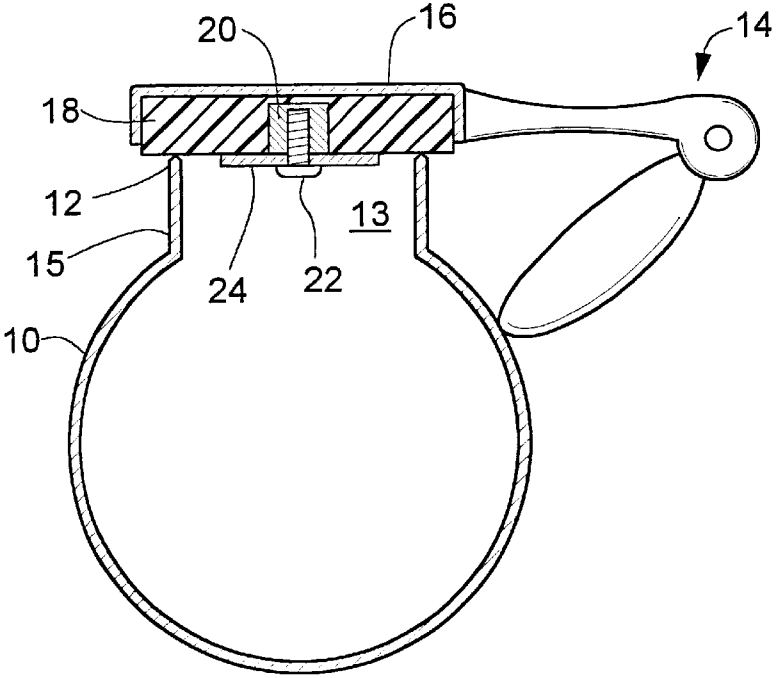
FIG. 1 PRIOR ART
FIG. 1 is a cross sectional view of a typical prior art closed hole or "American style" cup disposed over the tone hole of a musical instrument.

Closed hole or American style wind instruments such as flute 10, FIG. 1 include as many as seventeen tone holes 13 defined by tone hole rim 12 at the top of chimney 15 and covered by tone hole cup 16 attached to key assembly 14. Inside cup 16 is tone hole sealing pad 18 secured therein by the combination of spud 20 placed in an orifice in pad 18 in which screw 22 extends after passing through washer 24.

Figure 2:
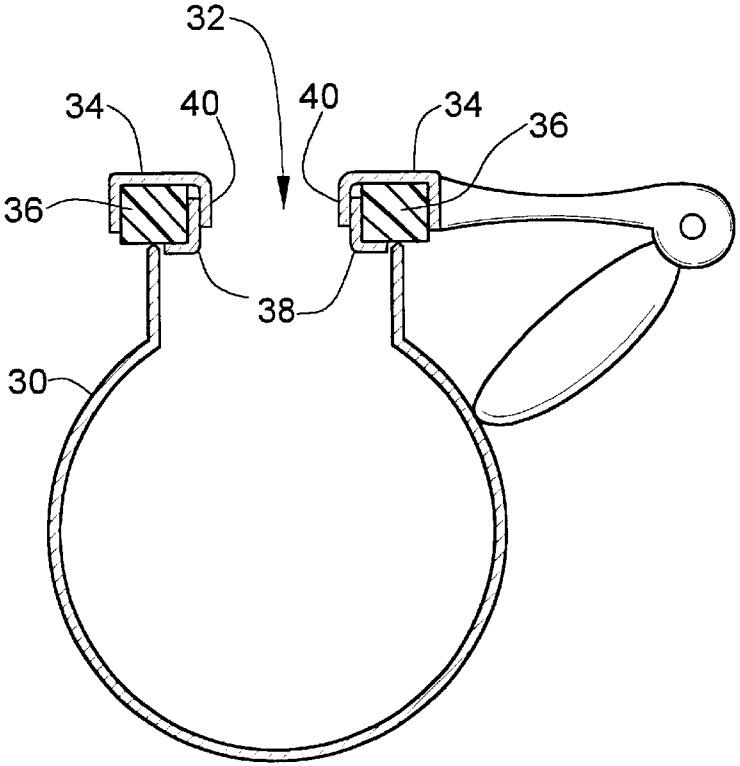
FIG. 2 PRIOR ART
FIG. 2 is a schematic cross sectional view of a typical prior art open hole or French style musical instrument cup.

In contrast, open hole or French cup flute 30, FIG. 2, has hole 32 in cup 34 extending through pad 36 which is either partially or fully covered by the musician's finger. Typically, as many as five cups of a flute are this open hole style. Pad 36 is retained in place in cup 34 by bushing or grommet 38 fitted between return 40 of cup 34 and pad 36.

In the prior art, cork or silicone plugs were used to seal hole 32 when the musician begins learning how to play the flute and then these plugs are removed either permanently by advanced musicians or temporarily by musicians who are beginning to practice more advanced techniques such as "half holing".

Figure 3:
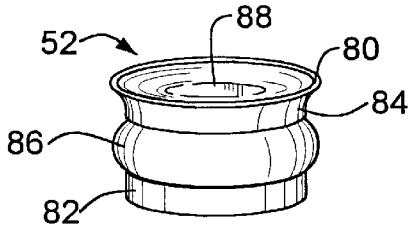
FIG. 3 is a schematic view of a single open hole cup plug in accordance with the subject invention.
Figure 4:
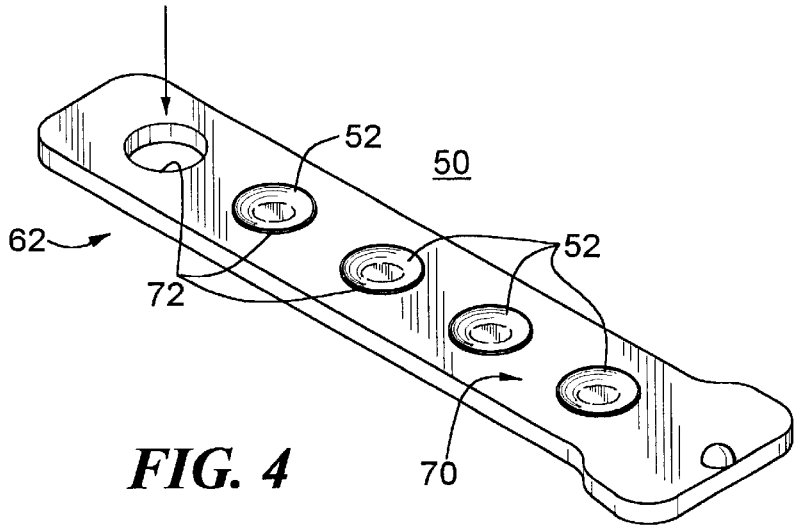
FIG. 4 is a schematic top view of the combined musical instrument open hole cup plug removal and storage tool of the subject invention.

In the subject invention, the numerous disadvantages of prior art cork and silicone plugs are overcome with kit 50, FIGS. 3–4 which includes uniquely configured open hole cup plugs 52 conveniently storable in orifices 72 disposed along the length of tool 62. In FIGS. 3 and 4, plug 52 is shown removed from orifice 72 in tool 62 and the remaining orifices in tool 62 are filled with four other similarly constructed open hole cup plugs. Tool 62 includes, on distal end 64 of body 70, protrusion 66 which assists the musician in removing a plug installed in an open hole cup as discussed infra.

Each plug 52 includes spaced upper 80 and lower 82 circular plates. Upper plate 80 includes lower beveled seating surface 84 for aesthetically and precisely positioning upper plate 80 over hole 32, FIG. 2 in cup 34 such that the top surface of upper plate 80, FIG. 3 is rendered nearly flush with the surface of cup 34, FIG. 2.

Plug 52 also includes elastomeric member 86 (e.g., a rubber O-ring) disposed between upper 80 and lower 82 plates for sealing open hole 32 in cup 34, FIG. 2. In the preferred embodiment, upper plate 80 includes a slight depression 88 on the top surface thereof configured to better position the musician's finger thereon.

Tool 62, which conveniently functions as both a storage device for a set of five open hole cup plugs and as a plug remover, includes a number of (e,g., five) plug receiving openings such as orifice 72 which preferably extends completely through the thickness of body 70 as shown. The distal end 64 of body 70 is typically enlarged to span across a tone hole rim and thus positions protrusion 66 under a plug to be removed so that it can be dislodged from the open tone hole cup.

Figure 5:
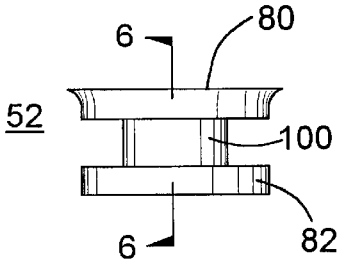
FIG. 5 is a front view of a portion of the open hole cup plug of FIG. 3.
Figure 6:
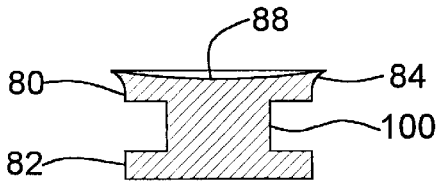
FIG. 6 is a sectional view taken along line 6—6 of the view of FIG. 5.

As shown in FIGS. 5–6, musical instrument open hole cup plug 52 preferably includes 0.150 inch diameter, 0.070 inch long stem 100 connected on one end to 0.311 inch diameter, 0.044 inch thick upper plate 80 and connected on the other end to 0.270 inch diameter, 0.044 inch thick lower plate 82. Seating surface 84 of upper plate 80 has a roundness of 0.025 inch.

Plug 52 may be machined from a single piece of stainless steel and may be plated with nickel and/or silver and is typically 0.158 inch tall. Depression 88 in the top surface of upper plate 80 typically has a roundness of 0.900 inch.

Metal bottom plate 82 functions as a hard resonating surface mimicking the structure of a closed hole cup thus providing a significant and important improvement over prior art cork and silicone plugs which adversely affected the tonal quality of the musical instrument.

Figure 7:
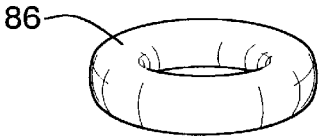
FIG. 7 is a top schematic view of the elastomeric O-ring portion of the open hole cup plug shown in FIG. 3.

Rubber O-ring 86, FIG. 7 is fitted over lower plate 82 and surrounds stem 100. O-ring 86 typically has a width of 0.060 inch, an inside diameter of 0.160 inch, and an outside diameter of 0.280 inch. Thus, in the preferred embodiment, for assembly purposes and to properly seal the tone hole of a given musical instrument, upper plate 80 has a diameter (e.g., 0.311 inch) greater than the outer diameter of O-ring 86 (e.g., 0.280 inch) and O-ring 86 has an outer diameter greater than the diameter of lower plate 82 (e.g., 0.270 inch).

Figure 8:
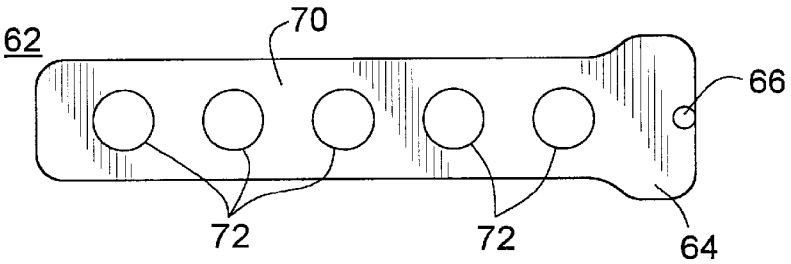
FIG. 8 is a schematic top view of the combined musical instrument open hole cup plug removal and storage tool shown in FIG. 4.
Figure 9:
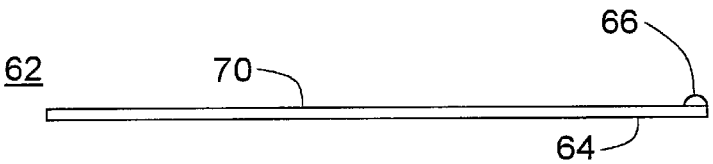
FIG. 9 is a side view of the tool shown in FIG. 8.

Three inch long by 0.050 inch thick plug storage/removal tool 62, FIGS. 8–9 is typically molded out of a plastic material and includes five 0.275 inch diameter holes 72 therethrough spaced on 0.500 inch centers along the length thereof as shown. Enlarged 0.500 inch long distal end 64 is approximately 0.750 inch wide; and tool 62 tapers to 0.650 inch in width for the majority of its length. Protrusion 66 extends 0.050 inch high from enlarged distal end 64 of tool 62 and has a bottom radius of 0.050 inch.

The dimensions discussed herein, however, are examples only and any modifications to them would be understood by those skilled in the art as required for different brands of flutes and other wind instruments.

Figure 10:
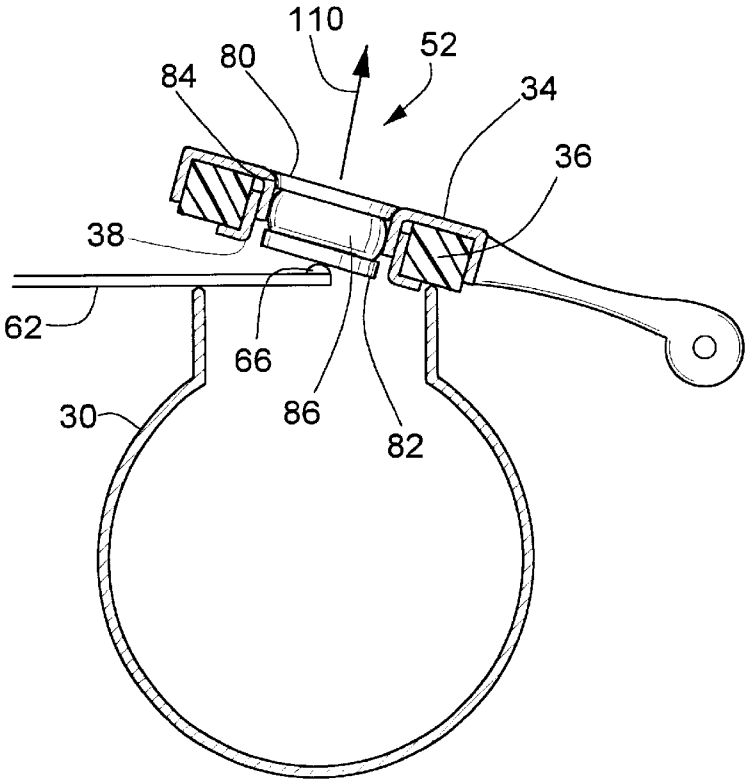
FIG. 10 is a schematic cross sectional view depicting the operation of the plug removal and storage tool of FIGS. 4, 8, and 9 positioned to remove the plug of FIGS. 3, 5, and 6 from an open cup of a musical instrument in accordance with the subject invention.

Because plug 52, FIG. 10 seats so precisely in open hole cup 34, it is somewhat difficult to remove without the assistance of a suitable tool.

Thus, combined remover/plug storage tool 62 is provided as a part of a kit and used by the musician as shown in FIG. 10 as a lever arm whereby protrusion 66 assists in dislodging plug 52 from open hole cup 45 in the direction shown by arrow 110.

Thereafter, plug 52 is conveniently placed in an open orifice 72, FIG. 4 in device 62 for secure and convenient storage. The use of tool 62, however, is not limited to the type of plug discussed above and could be manufactured to accommodate prior art cork or silicone plugs.

In the preferred embodiment, however, a set of five aesthetically pleasing, high quality open hole cup plugs (52, FIGS. 3, 5–7, and 10) are included. Due to metal bottom plate 82, there is no adverse effect to the resonance and pitch of the musical instrument. Combined plug remover and plug storage tool 62, FIGS. 4 and 8–10 prevents the loss or misplacement of open hole cup plugs of any configuration and is well suited to removing plugs such as plug 52, FIG. 10 from the open hole of a tone hole cup.

Although specific features of the invention are shown in some drawings and not in others, this is for convenience only as each feature may be combined with any or all of the other features in accordance with the invention.

Other embodiments will occur to those skilled in the art and are within the following claims:

What is claimed is:

1. A musical instrument open hole cup plug kit comprising:

a plurality of open hole cup plugs, each said plug including:

spaced upper and lower circular plates, the upper plate including a lower seating surface for aesthetically positioning the upper plate over the open hole, and an elastomeric member disposed between the upper and lower plates for sealing the open hole wherein said upper plate of the plug has a diameter greater than the diameter of the elastomeric member and the elastomeric member has a diameter greater than the diameter of the lower plate of the plug; and a plug removal/storage tool including:

a body including on a distal end thereof a protrusion, and a plurality of orifices in the body along the length thereof for storing the open hole cup plugs therein.

2. The kit of claim 1 in which each said plug further includes a stem interconnecting the upper and lower plates.

3. The kit of claim 2 in which the elastomeric member of the plug is an O-ring disposed about the stem.

4. The kit of claim 1 in which the upper plate of the plug includes a depression on an upper surface thereof.

5. The kit of claim 1 in which the lower seating surface of the upper plate of the plug has a radius configured to position the upper plate flush within a cup.

6. The kit of claim 1 in which the distal end of the body of the tool is enlarged to span a tone hole rim.

7. The kit of claim 1 in which the body of the tool has a length greatly exceeding its thickness.

8. The kit of claim 1 in which the orifices in the tool extend completely through the thickness of the body.

9. The kit of claim 1 in which the tool includes five orifices.

10. A musical instrument open hole cup plug comprising:

spaced upper and lower circular plates;

the upper plate including a lower seating surface for aesthetically positioning the upper plate over the open hole; and an elastomeric member disposed between the upper and lower plates for sealing the open hole; wherein said the upper plate has a diameter greater than the diameter of the elastomeric member and the elastomeric member has a diameter greater than the diameter of the lower plate.

11. The plug of claim 10 further including a stem connected on one end to the upper plate and connected on the other end to the lower plate.

12. The plug of claim 11 in which the elastomeric member is an O-ring disposed about the stem.

13. The plug of claim 10 in which the upper plate includes a depression on an upper surface thereof.

14. The plug of claim 10 in which the seating surface of the upper plate has a radius configured to position the upper plate flush within the cup.

15. A musical instrument open hole cup plug removal and storage tool comprising:

a body including on a distal end thereof a protrusion in which the distal end of the body is enlarged to span a tone hole rim; and a plurality of orifices in the body along the length thereof for receiving and orderly retaining open hole plugs therein removed from the open hole cups when the distal end of the body is placed between a tone hole rim and an open hole cup and the protrusion is used to dislodge the plug from the cup.

16. The tool of claim 15 in which the body has a length greatly exceeding its thickness.

17. The tool of claim 15 in which the orifices extend completely through the body.

18. The tool of claim 15 in which there are five orifices.

19. A musical instrument open hole cup plug kit comprising:

a plurality of open hole cup plugs, each said plug including:

spaced upper and lower circular plates, the upper plate including a lower seating surface for aesthetically positioning the upper plate over the open hole, and an elastomeric member disposed between the upper and lower plate for sealing the open hole; and a plug removal/storage tool including:

a body including on a distal end thereof a protrusion, and a plurality of orifices in the body along the length thereof for storing the open hole cup plugs therein, wherein the distal end of the body of the tool is enlarged to span a tone hole rim.

20. The kit of claim 19 in which each said plug further includes a stem interconnecting the upper and lower plates.

21. The kit of claim 20 in which the elastomeric member of the plug is an O-ring disposed about the stem.

22. The kit of claim 21 in which the upper plate of the plug includes a depression on an upper surface thereof.

23. The kit of claim 19 in which the lower seating surface of the upper plate of the plug has a radius configured to position the upper plate flush within a cup.

24. The kit of claim 19 in which the body of the tool has a length greatly exceeding its thickness.

25. The kit of claim 19 in which the orifices in the tool extend completely through the thickness of the body.

26. The kit of claim 19 in which the tool includes five orifices.

27. A musical instrument open hole plug kit comprising:

a plurality of open hole cup plugs, each said plug including:

spaced upper and lower circular plates, the upper plate including a lower seating surface for aesthetically positioning the upper plate over the open hole and having a radius configured to position the upper plate flush within a cup, and an elastomeric member disposed between the upper and lower plates for sealing the open hole; and a plug removal/storage tool including:

a body including on a distal end thereof a protrusion in which the distal end of the body is enlarged to span a tone hole rim, and a plurality of orifices in the body along the length thereof for storing the open hole cup plugs therein.

28. The kit of claim 27 in which each said plug further includes a stem interconnecting the upper and lower plates.

29. The kit of claim 28 in which the elastomeric member of the plug is an O-ring disposed about the stem.

30. The kit of claim 27 in which the upper plate of the plug includes a depression on an upper surface thereof.

31. The kit of claim 27 in which the body of the tool has a length greatly exceeding its thickness.

32. The kit of claim 27 in which the orifices in the tool extend completely through the thickness of the body.

33. The kit of claim 27 in which the tool includes five orifices.

* * * * *